US005241785A

United States Patent [19]

Meyer

[11] Patent Number: 5,241,785

[45] Date of Patent: Sep. 7, 1993

[54] STANDING SEAM PANEL AND CONSTRUCTION METHOD THEREFOR

[76] Inventor: Bruce E. Meyer, 686 Lookout Mountain Rd., Golden, Colo. 80401

[21] Appl. No.: 734,175

[22] Filed: Jul. 22, 1991

[51] Int. Cl.[5] ..... E04D 3/363

[52] U.S. Cl. ..... 52/520; 52/478; 52/529

[58] Field of Search ..... 52/537, 545, 528, 529, 52/354, 520, 478

[56] References Cited

U.S. PATENT DOCUMENTS

| | | | |
|---|---|---|---|
| 3,394,524 | 7/1968 | Howarth | 52/529 |
| 3,898,783 | 8/1975 | Matlock et al. | 52/529 |
| 4,120,123 | 10/1978 | Knudson | 52/528 |
| 4,495,743 | 1/1985 | Ellison et al. | 52/545 |
| 4,597,234 | 7/1986 | Simpson | 52/537 |
| 4,878,331 | 11/1989 | Taylor | 52/519 |
| 5,072,563 | 12/1991 | Menegoli | 52/537 |
| 5,140,793 | 8/1992 | Knudson | 52/520 |

OTHER PUBLICATIONS

UC System IV Coppersales, Inc.
The Standing Seam System by ASC Pacific Inc. (1986)
BuyLine 5975.
BuyLine 5975 showing Quality Inn. ESCO.
Knudson DR-12 Combo BuyLine 4839.
BuyLine 4863, specificaly Slim Seam.
BuyLine 3031.
BuyLine 1539 MM Systems, Corp.

*Primary Examiner*—Carl D. Friedman
*Assistant Examiner*—Winnie Yip
*Attorney, Agent, or Firm*—Timothy J. Martin; Dana S. Rewoldt

[57] ABSTRACT

A standing seam panel for assembly into surface covering is constructed to have a central panel section with a female profile along one lateral edge and a male profile along the other lateral edge so that adjacent panels may snap-fit together by engaging the matable profiles. The female profile is formed as an inverted U-shaped channel by an inner side web and an outer side web interconnected by a top wall. The male profile is formed by a first end wall, an inwardly projecting intermediate wall opposed to an edge portion of the central panel section adn an inset wall extending upwardly from the intermediate wall. The edge portion of the central panel section thus form an inwardly-facing channel, and the female profile includes a detent structure that engages the inwardly facing channel when a male profile is mated with a female profile. A fan-fold fabrication method for forming the profiles as a continuous process of flat sheet stock is described.

14 Claims, 5 Drawing Sheets

STANDING SEAM PANEL AND CONSTRUCTION METHOD THEREFOR

FIELD OF THE INVENTION

The present invention generally relates to protective coverings for surfaces. Specifically, however, the present invention relates to interlocking panel strips used to construct buildings as an exterior covering for roofs, walls, awnings and the like. In particular, the present invention concerns standing seam panels having interlocking lateral profiles and methods of constructing those panels.

BACKGROUND OF THE INVENTION

The use of various paneling and shingling systems are well-known in the construction arts. Among these systems are those types referred to as "standing seam panel" systems wherein a plurality of elongated panels, each having at least one upstanding lateral edge, are placed alongside one another and are affixed to the surface to be covered and protected thereby. In some instances, these existing standing seam panels employ lateral edge profiles which mate with one another so that adjacent lateral edges are releasably locked together in a relatively weather-proof manner. In other constructions, a batten cap snap-locks onto a pair of adjacent lateral edges of the elongated panels in an attempt to weather-proof the seam therebetween. In each of these systems, auxiliary clips are normally used to secure a lateral edge of one or both of the adjacent elongated panels to the surface, and the profile of either of the other adjacent lateral edge or the batten cap then mounts over the clip-secured lateral edge or edges in a releasably locking manner. In either event, the releasable interlocking structure maybe provided directly by the adjacent lateral edges or by the auxiliary attachment clips.

While standing seam panel constructions have been quite useful as a construction material, some problems have been observed with existing standing seam panel systems. For example, where an auxiliary clip is used to attach one adjacent lateral edge of an elongated panel to a surface so that the auxiliary clip provides the releasably locking structure to secure a mating lateral edge of an adjacent elongated panel, the interlock occurs only at the clip locations. These systems therefore have a limited degree of interlock at their lateral edges which diminishes the integrity of the system since the adjacent lateral edges can be more easily and inadvertently disengaged from one another, as may occur from the effect of wind on the surface. This problem can be somewhat eliminated by providing a clip as a continuous strip that extends completely along the lateral edge, but this increases the complexity of manufacture and installation of the panel system, as well as increases the cost of the covering system.

On the other hand, where the lateral edges of the elongated panels are provided with continuous interlocking profiles, the dominant problem has been the difficulty of fabricating the interlocking profiles along the lateral edges of the panel strips. Often, there is seen to be a trade-off between the ease of manufacture and the strength of the interlocking profiles. Typically, the elongated panels are formed by configuring the longitudinal edges of a flat piece of panel stock material, such as a metal strip, by folding and bending the lateral margins into the desired interlocking profile. In order to reduce the complexity of this folding, both manufacturers of pre-fabricated standing seam panels and manufacturers of machinery to do on-site fabrication of the standing seam panels have sacrificed the integrity of the interlocking systems for ease in fabrication. That is, some manufacturers have resorted to simpler profiles that do not lock as strongly together in order to reduce manufacturing costs.

According, there remains a need for simplified profiles and manufacturing techniques whereby standing seam panels can be fabricated either at a remote facility or by movable, on-site machinery, yet which profiles exhibit a strong integrity in their interlocking structure. Thus, despite the successes of existing standing seam panel systems, there remains a need for improved interlocking profile configurations that achieve a strong, releasable interlock from the profiles of adjacent panels when mated with one another yet which profiles are simple and inexpensive to fabricate. The present invention is believed to satisfy these needs.

SUMMARY OF THE INVENTION

It is an object of the present invention to provide a new and useful standing seam panel structure that is inexpensive to manufacture.

Another object of the present invention is to provide a standing seam panel having interlocking profiles which may be manufactured in a simplified manner yet which structure provides mating male and female profiles that strongly interlock with one another when the panels are used to cover a surface to be protected.

A further object of the present invention is to provide a standing seam panel having matable male and female profiles that can be fan-folded by continuous fabrication machinery so that an efficient folding process produces a panel with a low number of folding steps.

Still a further object of the present invention is to therefore provide a new and useful fabrication method for standing seam panels and which method is of reduced complexity so that it utilizes simplified fabrication machinery.

Yet another object of the present invention is to provide a construction method for standing seam panels that is economical to employ and which may be implemented by fixed site production machinery or by movable machinery which may be transported for on-site fabrication.

According to the present invention, then, a standing seam panel is provided and is adapted to mount on a surface as a protective covering. Broadly, the standing seam panel has a central panel section and first and second standing seams located between opposite lateral edges thereof so that the standing seam panel has a longitudinal length and a width between the lateral edges. The first standing seam is formed by an upstanding inner side web connected to the central panel section proximate the first lateral edge and an outer side web which is connected to the inner side web by a top web so that it downwardly depends and extends alongside said inner side web in spaced relation thereto oppositely the central panel section. The outer side web terminates in an inwardly facing ridge that defines a detent structure at a mouth opening into the channel interior. Thus, the first standing seam defines a female profile having a proximal edge along the first lateral edge of the central panel section, a top portion at said top web and a distal edge proximate the detent structure.

The second standing seam is located along the second lateral edge of the central panel section and projects in a common direction with the first standing seam by having an upstanding first wall connected to the central panel section proximate the second lateral edge, an intermediate wall connected to said first end wall and extending inwardly in opposed relation to said central panel section and an inset wall connected to said intermediate wall opposite said first end wall and extending upwardly therefore to terminate at an upper portion. Thus, the second standing seam defines a male profile which includes a second channel opening towards said first standing seam. The male and female profiles are sized to matable engage one another, and, to this end, the height of the outer web of the first standing seam as well as the dimension of the second channel is such that the ridge-formed detent structure on the female profile engages the second or detent channel of the male structure when the top and upper portions of the respective profiles are positioned next to one another in a mated state thereby to releasably lock the profiles together.

Preferably, the central panel section and both standing seams are constructed of a unitary piece of material having longitudinal fan folds which form the male and female profiles. This material is preferably a metal stock, however, whatever the material used for these standing seams should be such that the female profile has sufficient resiliency to snap-lock around the male profile.

The preferred structure of the first standing seam is such that the inner web is oriented in a first plane that is perpendicular to the plane of the central panel section. Further, it is preferred that the outer web is parallel to this inner web. With respect to the second standing seam, by a top wall that forms the upper portion of the male profile and that a second end wall downwardly depends from the top wall in spaced apart relation to said inset wall oppositely said central panel section to terminate in a second end wall distal edge. Preferably, the second end wall and the inset wall are at an acute angle with respect to one another so that they converge toward one another at the top wall. When the first end wall is perpendicular to the central panel section, the first and second end walls may be oriented in a common plane. Alternately, the second end wall can extend outwardly of and alongside the first end wall to terminate at a location proximate the second lateral edge of the central panel section.

Furthermore, according to the present invention, a broad method is provided for forming the standing seam panel described above out of a flat stock of bendable material having a selected width between first and second side edges and a longitudinal length. The broad method includes a first step of bending a first margin of the flat stock proximate the first edge to produce a female profile defining a standing seam. This step of bending the first margin is accomplished by the steps of forming a longitudinal ridge edge along the first side edge of the flat stock by longitudinally creasing a first margin of the flat stock adjacent the first edge, by forming an upstanding inner web by longitudinally folding the first margin at an inner edge thereof so that a first lateral edge is created for the standing seam panel and by forming an inverted first channel by reverse folding a middle portion of the first margin outwardly of the central panel section so that the inverted first channel has a downwardly opening mouth and so that the ridge forms a detent structure at the mouth of the first channel. A male profile is formed out of the second margin out of the flat stock adjacent the second with the male profile sized to matably receive and engage the female profile in a mated state. The male profile is created by the steps of forming an intermediate by longitudinally bi-folding a middle portion of the second margin, by forming an upstanding lower end wall and an upper inset wall by longitudinally folding the second margin at an inner edge thereof so that the second lateral edge for the panel is created and so that the intermediate wall is positioned and spaced apart opposed relation to the central panel section to create a detent channel that opens inwardly toward the central panel section, and by forming an arcuate top wall by longitudinally bending an outer portion of the second margin between the intermediate wall and the second side edge so that the top wall extends outwardly of the inset wall.

Preferably, the steps of forming the male and female profiles are conducted contemporaneously. When forming the female profile, the step of forming the ridge also preferably precedes the upstanding inner web. Further, it is preferred that the step of forming the upstanding lower end wall and the step of forming the top wall occur contemporaneously. Further, the top wall is preferably formed by reverse bending the outer portion of the second margin arcuately to form an arcuate top wall and to simultaneously form an upper end wall that is outwardly spaced from the inset wall. This upper end wall may be formed in a common plane with the lower end wall by this bending step.

These and other objects of the present invention will become more readily appreciated and understood from a consideration of the following detailed description of the preferred embodiment when taken together with the accompanying drawings, in which:

DETAILED DESCRIPTION OF THE EXEMPLARY EMBODIMENTS

The present invention broadly concerns protective coverings for surfaces and especially concerns the covering of the exterior surfaces of buildings such as the surfaces found on roofs, awnings, walls, etc. The present invention specifically concerns paneling constructs of the type known as "standing seam" panels wherein a plurality of elongated panel strips are used to cover a surface with upstanding adjacent edges of adjacent ones of these strips being matably interlocked when assembled. The present invention also concerns the fabrication method for these standing seam panels.

Figure 1:
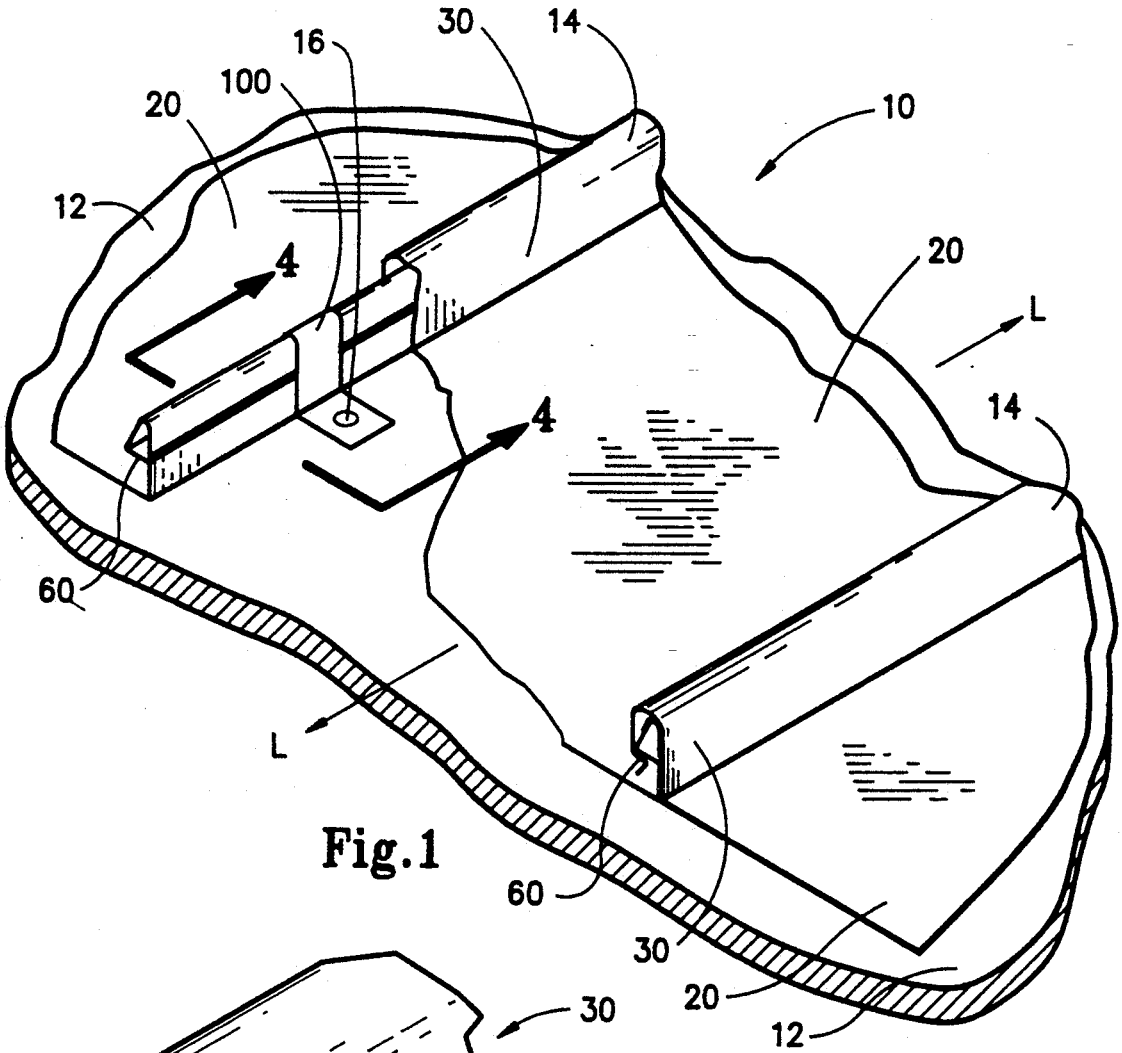
FIG. 1 is a perspective view, partially broken away, showing the standing seam panel system according to the first exemplary embodiment of the present invention.

Accordingly, with reference to FIG. 1, it may be seen that a covering 10 may be provided by a plurality of standing seam panels 20 which are elongated along a longitudinal axis L. Each standing seam panel 20 has a female profile 30 and a male profile 60 at opposite lateral edges so that the adjacent lateral edges of the adjacent standing seam panels 20, as shown in FIG. 1, may mate with one another at upstanding seams 14. An auxiliary attachment clip 100 is provided to mount standing seam panels 20 to surface 12, and fasteners such as fastener 16 are used to mount auxiliary clips 100 to surface 12.

Figure 2:
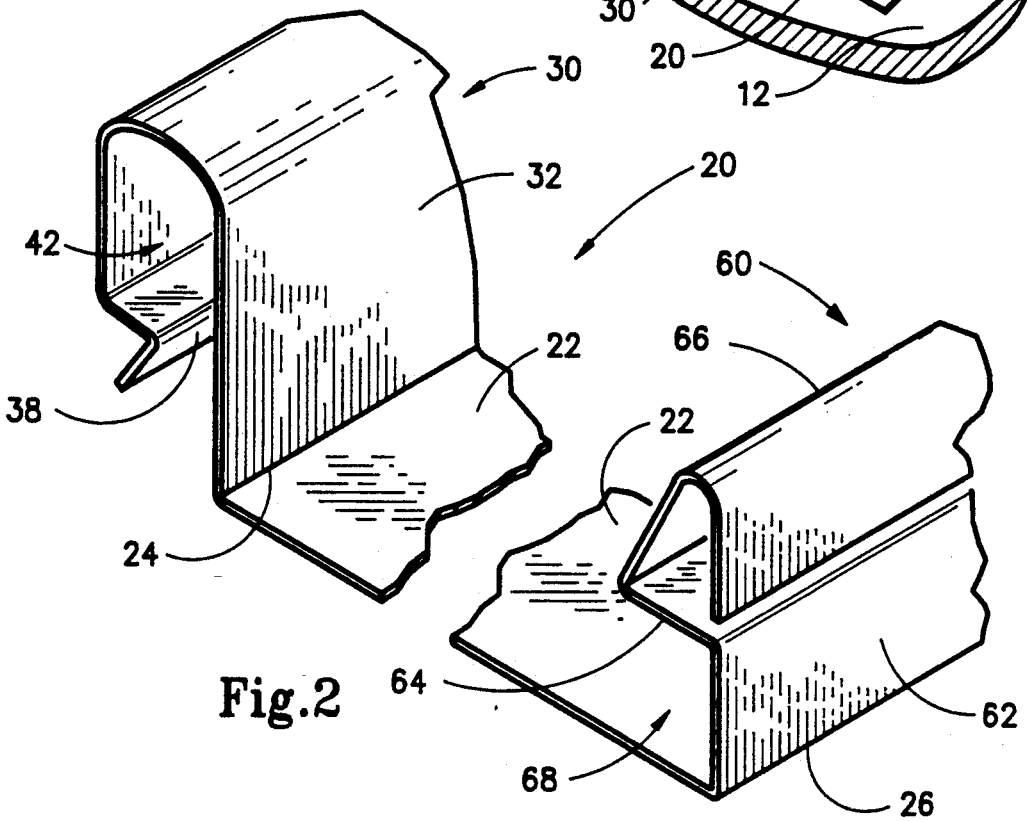
FIG. 2 is a perspective view of a standing seam panel according to this first exemplary embodiment of the present invention as implemented in the system shown in FIG. 1.
Figure 3:
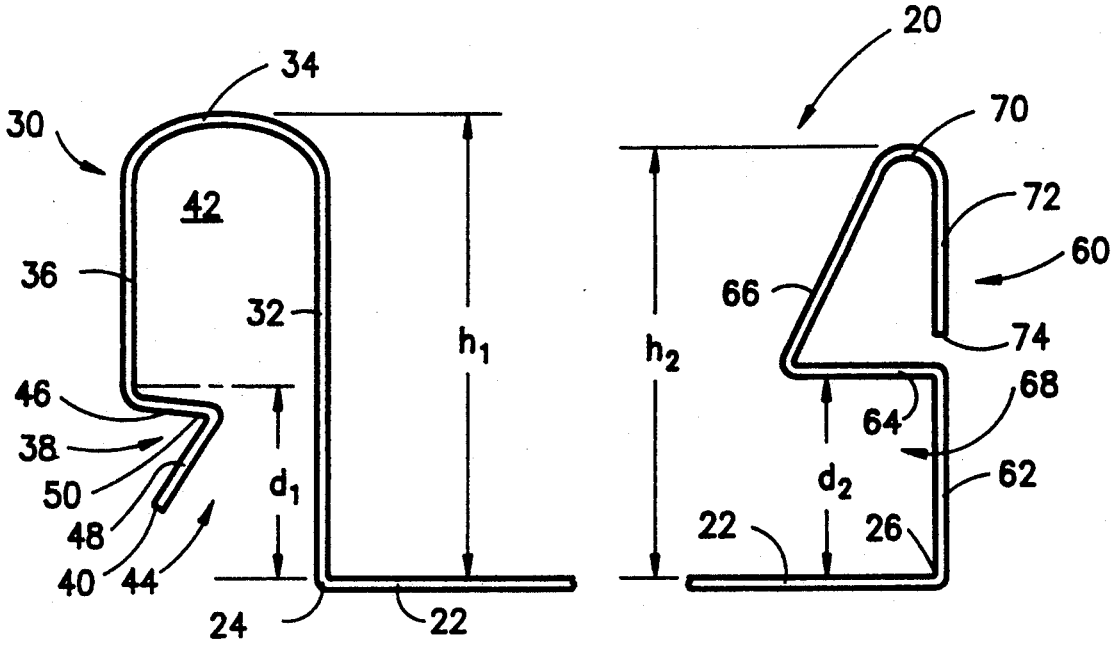
FIG. 3 is an end view in elevation showing the male and female profiles of the standing seams of the panel shown in FIG. 2.
Figure 4:
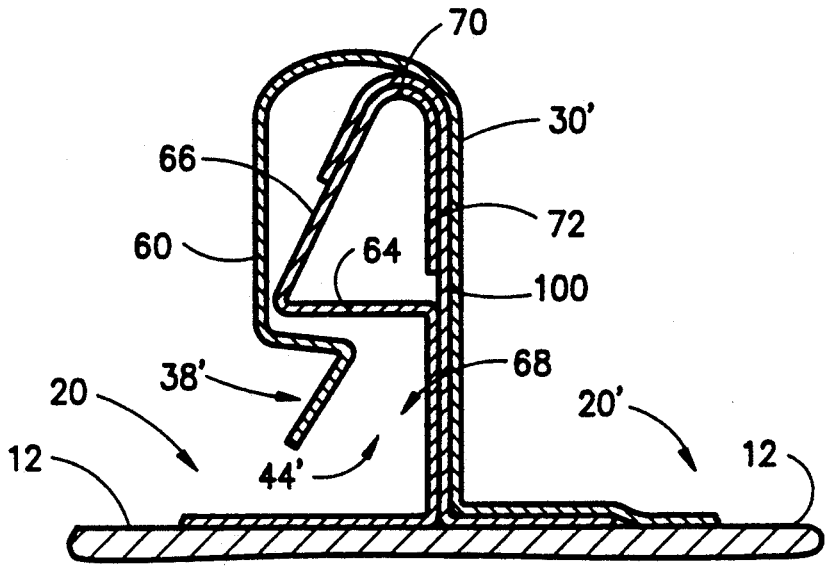
FIG. 4 is an end view in cross-section, taken about lines 4—4 of FIG. 1, and showing the mating of a pair of adjacent standing seam panels at the adjacent lateral edges thereof and the securing of the same to a support surface.
Figure 5A:
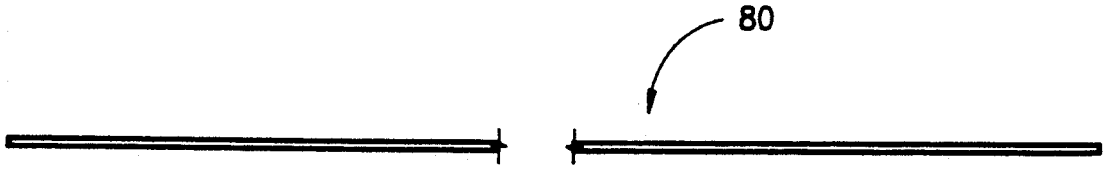
FIGS. 5(*a*)-5(*e*) show, in diagrammatic form, the bending of a flat piece of panel stock material into the standing seam panel shown in FIGS. 1–4.
Figure 5B:
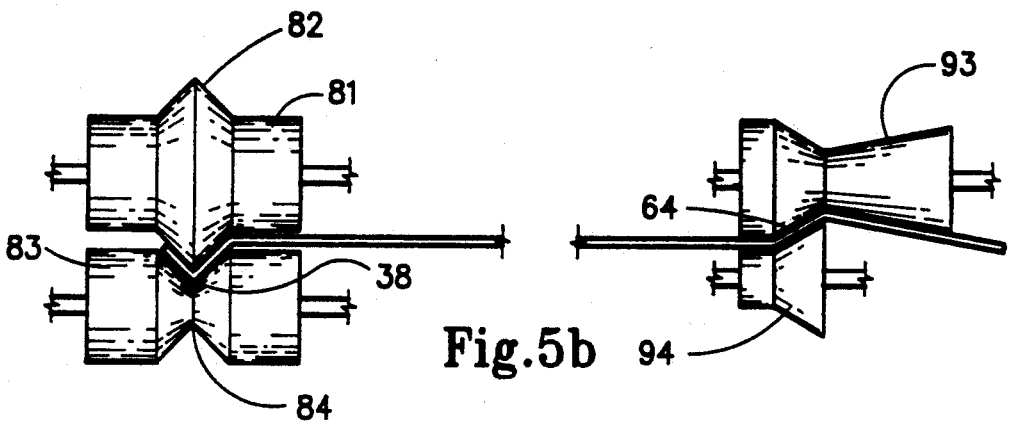
Figure 5C:
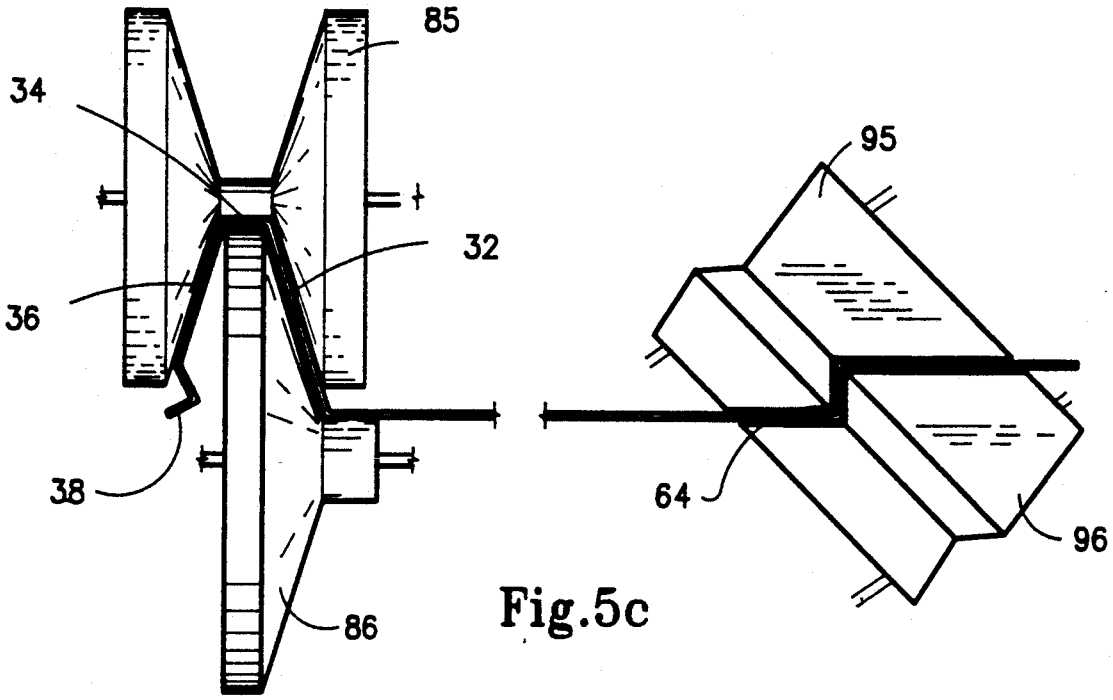
Figure 5D:
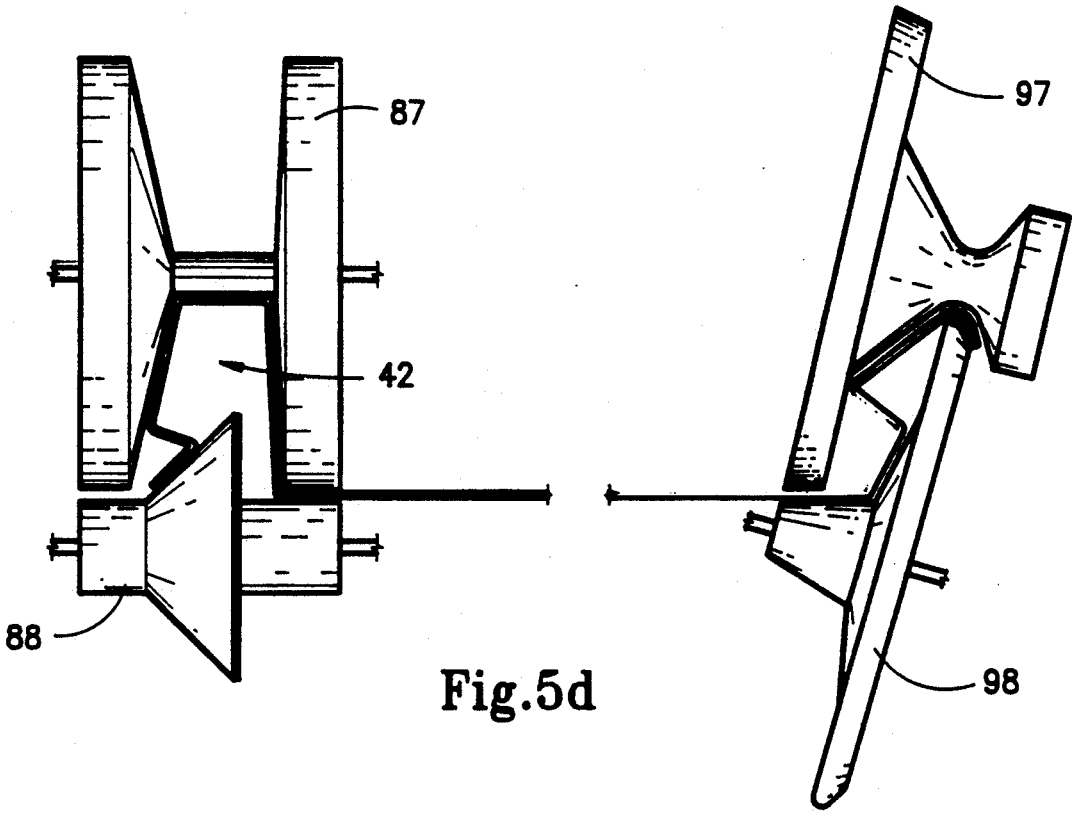
Figure 5E:
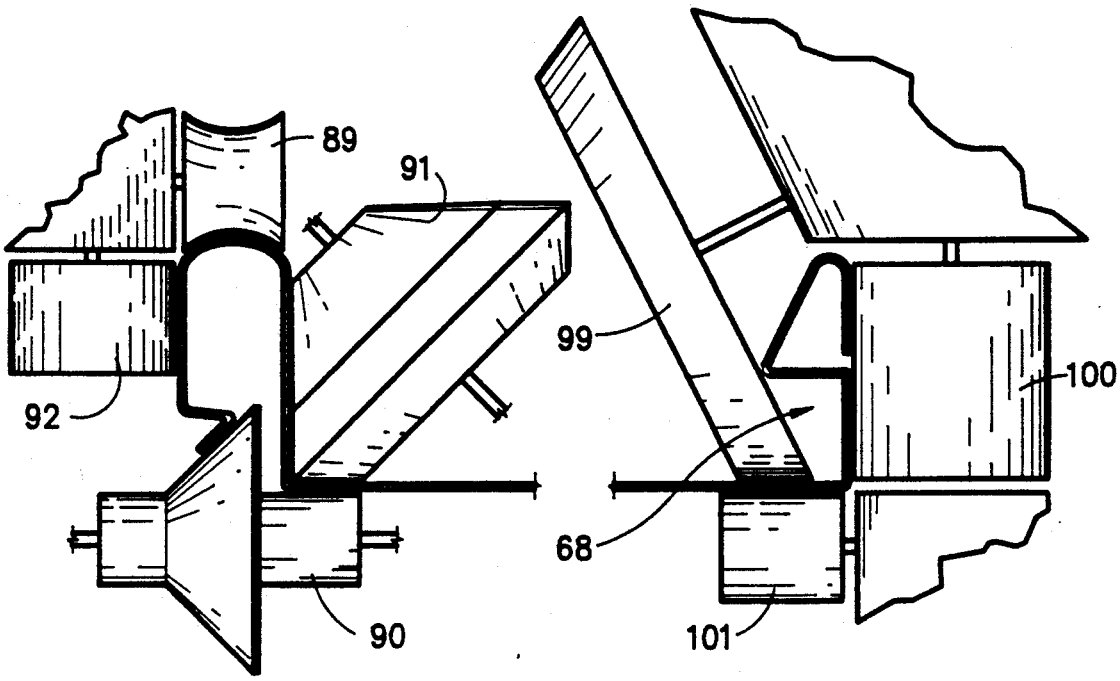

The structure of each standing seam panel 20 is best shown in reference to FIGS. 2–4 where it may be seen that female profile 30 and male profile 60 are respectively formed along first and second lateral edges 24 and 26 of central panel section 22. Accordingly, each of the profiles 30 and 60 extend longitudinally of standing seam panel 20 for the longitudinal length of the lateral edges 24 and 26 and define a width therebetween for standing seam panel 20. Preferably, standing seam panel 20 is constructed out of a flat piece of metal stock by bending profiles 30 and 60 in the manner described below. However, it should be appreciated that standing seam panel 20 could be constructed out of other materials and could, for example, be an extruded plastic panel. Where constructed out of metals, though, it is preferred that standing seam panel 20 be made out of a malleable metal such as aluminum, steel, cooper, tin and the like.

With reference to FIGS. 2 and 3, it may be seen that female profile 30 is formed as an inverted channel shaped structure by an upstanding inner web 32, and arcuate top web 34 and a downwardly depending outer web 36 which terminates in an inwardly projecting ridge 38 at distal edge 40 thereof. Outer web 36 is located outwardly of inner web 32 with reference to central panel section 22 so that are inverted channel 42 is formed therebetween with channel 42 having a downwardly opening mouth 44. Ridge 38 is V-shaped and is formed by walls 46 and 48 to have a vertex 50 that is opposed to inner web 32 in order to define a necked region so that downwardly facing opening or mouth 44 is narrower than the central region of channel 42. Ridge 38 thus forms a detent structure as discussed more thoroughly below. This detent structure is located a distance $d_1$ above central panel section 22. Accordingly, female profile 30 has a proximal edge at lateral edge 24 of central panel section 22, a top portion formed by top web 34 and a distal edge 40 forming a free edge for wall 46.

A second lateral edge 26 of central panel section 22 opposite lateral edge 24 is provided with a male profile 60 which again maybe seen best in reference to FIGS. 2 and 3. Here, male profile 60 is formed by a first upstanding end wall 62 and inset wall 66 and an intermediate wall 64 which joins first upstanding end wall 62 and inset wall 66. Intermediate wall 64 extends from first upstanding end wall 62 in a direction towards female profile 30 so that it is in an opposed relation to central panel section 22 and preferably is parallel thereto and extends above central panel section 22 a distance "$d_2$". Accordingly, an inwardly facing second channel 68 is formed by first upstanding end wall 62, intermediate wall 64 and that portion of central panel section 22 which is opposed by intermediate wall 64. Inset wall 66 extends at a large acute angle at a large acute angle upwardly from intermediate wall 64 to an upper portion defined by an arcuate top wall 70 from which downwardly depends an outer second end wall 72. Thus, end wall 72 extends downwardly from arcuate top wall 70 to terminate in a free edge 74. With this construction, inset wall 66 and second end wall 72 converge toward top wall 70 so that they are oriented at an acute angle with respect to one another.

As best shown in FIG. 3, it may be seen that first web 32 of female profile 30 is preferably formed perpendicularly to central panel section 22 and second web 36 is outwardly spaced and parallel relation to first webs 32. Likewise, first end wall 62 of male profile 60 is formed perpendicularly to central panel section 22 while inset wall 66 is located in a plane oriented at an acute angle to the plane of first wall 62. While it is not essential, intermediate wall 64 may preferably be parallel to central panel section 22 and thus perpendicular to first wall 62. Finally, it may be seen in reference to FIG. 3 that second end wall 72 may be oriented in a plane common with first end wall 62.

With reference again to FIG. 3, it should be appreciated that female profile 30 has a height "$h_1$" that is slightly larger than the height of male profile "$h_2$". Furthermore, the detent structure formed by ridge 38 begins at a distance "$d_1$" above central panel section 22 which is slightly less than the width "$d_2$" of second channel 68. Accordingly, as is shown in FIG. 4, when a first standing seam panel 20 is mated with an adjacent, second standing seam 20', the male profile 60 is matably engaged with female profile 30' with the head of the male profile 60, as defined by walls 64, 66, 70 and 72 being received within channel 42' of female profile 30'. By virtue of the convergent orientation of walls 66 and 72, top wall 70 forms a narrow nose that easily fits into mouth 44' of channel 42'. Walls 66 and 72 therefore ramp web 36 away from web 32. Thus, detent ridge 38' snap-locks into channel 68 of standing seam panel 20 to lock the two panels together. Further, in order to hold down standing seam panel 20 during initial installation, a plurality of auxillary attachment clips, such as attachment clip 100 maybe mounted to extend around the upper arcuate wall 70 of male profile 60 at selected intervals therealong, as is also shown in FIG. 1. This clip 100 may be engaged by female profile 30', as is shown in FIG. 4, due to the resilient nature of the female profile.

The installation of the standing seam panel system according to the preferred embodiment of the present invention may now thus be more fully appreciated with reference to FIG. 1. A first standing seam panel is placed on a surface 12 to be covered and is retained in position by means of clips such as auxiliary clip 100 extending at spaced intervals along with longitudinal length of male profile 60. A second standing seam panel 20 is then snap-fit over the fastened male profile of the first standing seam panel by engaging the male profile 60 with the female profile 30 of the adjacent standing seam panel. A plurality of clips 100 may then be used to secure the male profile of the second standing seam panel, as described above, and the female profiled of a third standing seam panel may be snap-fit over the male profile and securing clips of the second standing seam panel. This process is then repeated until the surface is covered.

The fabrication of standing seam panel 20 may be best appreciated with reference to FIGS. 5(*a*)–5(*e*). Here it may be seen that female profile 30 and male profile 60 may be simultaneously bent by fan folding an integral piece of flat stock material with a plurality of forming rollers. Thus, a flat metallic sheet 80 shown in FIG. 5(*a*) may have a first margin proximate a first side edge which is bent to form a female profile by first forming a longitudinal ridge along the first side edge thereof by longitudinally creasing the first margin. This is accomplished by means of a pair of forming rollers 81 and 83. To this end, roller 81 includes a circumferential ridge 82 which mates in a circumferential channel 84 in roller 83 so that ridge 38 is formed therebetween, as shown in FIG. 5(*b*). Next, webs 32, 34 and 36 are partially formed by a pair of forming rollers 85 and 86 which bend an inward portion of the margin to create these three webs, as shown in FIG. 5(*c*). Female profile 30 is then further formed by moving side wall 36 more closely into a parallel relationship with side wall 32, as shown in FIG. 5(*d*). This is accomplished by means of forming rollers 87 and 88. Finally, as shown in FIG. 5(*e*) female profile 30 is finished by means of forming rollers 89 and 90 along with bearings 91 and 92.

Male web 60 is formed simultaneously with female web 30. Thus, turning again to FIGS. 5(*a*) and 5(*b*), it may be seen that a second margin portion of stock material 80 forms a male web 60 by first forming intermediate wall 64, as shown in FIGS. 5(*b*) and 5(*c*). The formation of intermediate wall 64 is accomplished by forming rollers 93 and 94, in FIG. 5(*b*) and completed by forming rollers 95 and 96, as shown in FIG. 5(*c*). Next, bottom end wall 62 and inset wall 64 are formed by simultaneously bending the margin of stock material 80 at a lateral edge 26 and by forming arcuate top wall 70 adjacent the outer edge of stock material 80. This forming step is accomplished by means of forming rollers 97 and 98. Male profile 30 is completed, as shown in FIG. 5(*e*) by continuing the bend of bottom wall 62 so that it is perpendicular with the central panel section 22 of stock material 80. Likewise, top wall 70 is further bent so that upper end wall 72 is bent into a common plane with bottom end wall 62. This formation is accomplished by means of rollers 99, 100 and 101. This completes the formation of detent channel 68.

It should be appreciated in reference to FIGS. 5(*a*)–5(*e*) that the bending technique of stock material 80 is very efficient and requires simplified machinery since the entire male and female profiles are bent by fan-folding the first and second margins of the material thus avoiding any undercuts or other complicated configurations which are difficult to implement. Further, with reference to FIGS. 5(*b*) and 5(*c*), it may be seen that it is preferable to form the detent ridge before forming the upstanding inner web. Likewise, with reference to FIG. 5(*d*), it may be seen that the preferred method includes the step of forming the upstanding lower end wall contemporaneously with the forming of the arcuate top wall.

Figure 6:
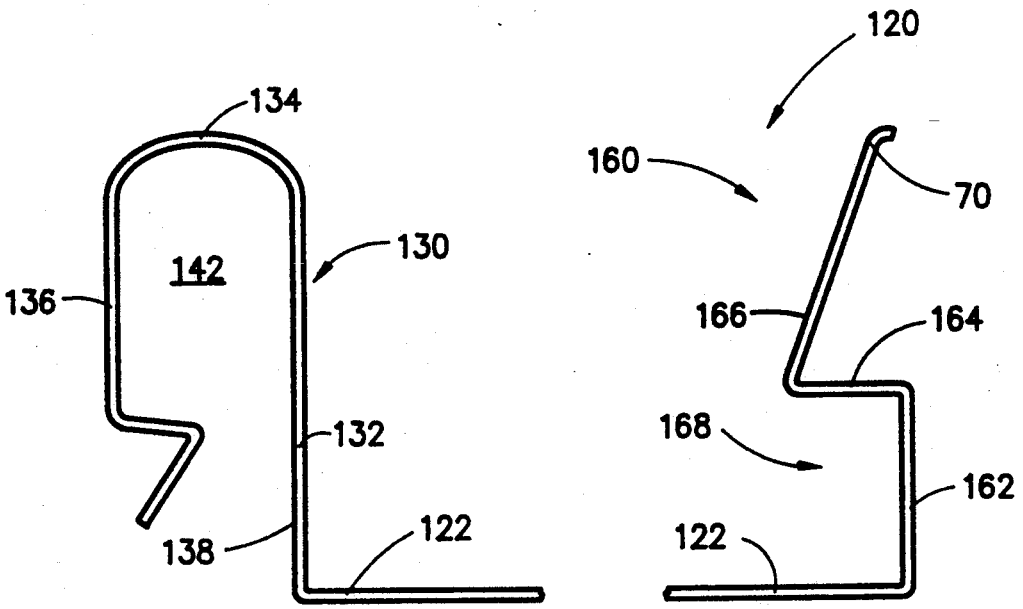
FIG. 6 is an end view in elevation showing a first alternative exemplary embodiment of the present invention.
Figure 7:
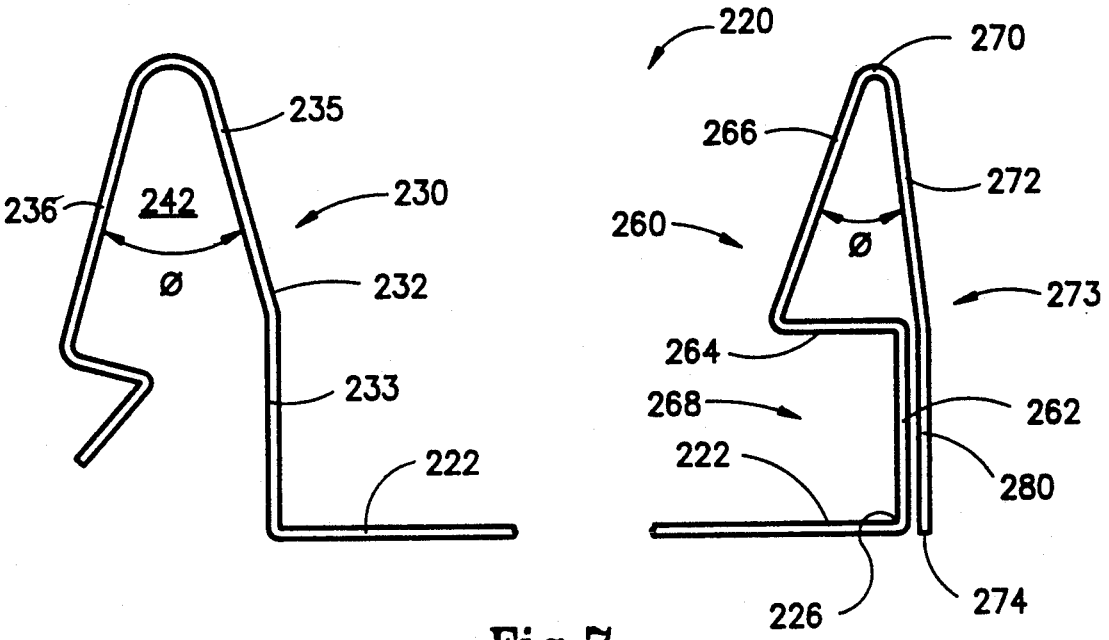
FIG. 7 is an end view in elevation showing a second alternative exemplary embodiment of the present invention.

First and second alternative embodiments to the standing seam panel described with respect to FIGS. 1–4 are shown in FIGS. 6 and 7. First, with respect to FIG. 6, it may be seen that standing seam panel 120 is constructed substantially identical to standing seam panel 20, and, indeed, has a female profile 130 that extends upwardly from central panel section 122 with female profile 130 being identical to female profile 30 described above. However, male profile 160 which extends upwardly from central panel section 122 is constructed slightly differently than male profile 60.

With reference to FIG. 6, it may be seen that male profile 160 of this first alternative embodiment includes a first outer end wall 162, and intermediate wall 164 and an inset wall 166 that are respectively the same as walls 62, 64 and 66 described with respect to male profile 30. However, the male profile 160 of standing seam panel 120 terminates in an arcuate top wall 170 having a free edge 174 located at the uppermost portion of male profile 160 to define a top portion therefore. That is, the second end wall (end wall 72 in the first embodiment) is eliminated and arcuate top wall 170 is foreshortened. Structuring male profile 160 as shown in FIG. 6 simplifies the bending of the male profile and requires a smaller margin of central panel section 122 to fabricate. Therefore, for a given width of the standing seam panel, less material is used without sacrificing the majority of the structural strength provided by male profile 30. When a male profile 160 is mated in channel 142 of female profile 130, then, top wall 170 abuts arcuate web 132 which joins first and second webs 132 and 136 of female profile 130. Again, detent ridge 138 mates in second detent channel 168. By extending female profile 160 so that top wall 170 will abut top web 134, unwanted deflection of the standing seam panel is reduced so that a strong interlock is maintained even though the second upper end wall 72 has been eliminated.

As discussed with respect to the preferred embodiment, the first and second webs which form the female profile were described as being parallel to one another. While this is preferred, it is not essential, and adequate structure can be provided utilizing the features described above with some slight departure in construction. For example, in FIG. 7, standing seam panel 220 is shown and includes a central panel section 222 from which upwardly extend a female profile 230 and a male profile 260. Female profile 230 includes a first upstanding web 232 formed by a lower web portion 233 and an upper web portion 235. Lower web portion 233 is oriented perpendicularly to central panel section 222 while upper web portion 235 is oriented at a slight acute angle with respect to the perpendicular plane defined by lower web portion 233. A second, outer web portion 236 is oriented at an angle $\phi$ with respect to web portion 235 so that channel 242 is an inverted V-shaped structure. Outer web 236 terminates in an outer detent edge 238.

In order that male profile 260 be configured to mate with the inverted V-shaped channel 242, modification is made to the configuration thereof. To this end, male profile 260 includes a first end wall 262, an intermediate wall 264 and an inset wall 266. Again, end wall 262 is formed perpendicularly of central panel section 222 and intermediate wall 264 is formed perpendicularly to wall 262 so that it is opposed to a portion of central panel section 222 to define a second detent channel 268 which will mate with detent ridge 238. Instead of forming inset wall 266 perpendicularly to intermediate wall 264, however, intermediate wall 266 is formed at a large arcuate angle with respect thereto and terminates in a narrow top wall 170 which then extends downwardly in an upper, second end wall 272. Inset wall 266 and second end wall 272 are formed at an angle $\phi$ which is the same as that of webs 235 and 236 so that the head portion 273 of male profile 260 will nest in channel 242. An additional feature is shown in this embodiment in the form of an auxillary end wall 280 which depends downwardly from second end wall 272 so that it is in closely spaced-apart parallel relation to first end wall 262. Auxillary end wall 280 terminates in a free edge 274 which is adjacent lateral edge 226 of central panel section 222 and provides additional support for head 273 of male profile 260 against bending moments. It should be appreciated that a wall similar to wall 280 could be provided, if desired, with respect to the embodiment shown in FIGS. 1–4 without departing from the scope of this invention. However, it would be necessary to slightly adjust the arcuate width of top wall 70 to accommodate an auxillary wall since it would be necessary to move second end wall 72 out of the plane of first end wall.

Accordingly, the present invention has been described with some degree of particularlity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

I claim:

1. A standing seam panel adapted to mount on a surface as a protective covering, comprising:

(a) a central panel section having a longitudinal length and a width between opposite first and second lateral edges thereof;

(b) a female profile extending along the first lateral edge of said central panel and including an upstanding inner side web connected to said central panel section adjacent the first lateral edge thereof and an outer side web connected to said inner side web by a top web and downwardly depending therefrom to extend in spaced relation with respect to said inner side web oppositely said central panel section to form a inverted first channel having a first channel interior, said outer side web terminating in an inwardly facing ridge defining a detent structure, said female profile having a proximal edge at the first lateral edge of said central panel section, a top portion at said top web and distal edge proximate said ridge; and (c) a male profile extending along side the second lateral edge of said central panel section and including an upstanding first end wall connected to said central panel section adjacent the second lateral edge thereof, an intermediate wall connected to said first end wall inwardly in opposed relation to said central panel section and an inset wall connected to said intermediate wall opposite said first end wall and extending upwardly from said intermediate wall so that said intermediate wall, said first end wall and a portion of said central panel adjacent to the second lateral edge form a second channel having an opening facing toward said female profile and so that said inset wall extends upwardly to an upper portion of said male profile, said male profile sized to matably engage said female profile with said second channel sized and positioned to receive said detent structure of said female profile whereby adjacent ones of said standing seam panels may be secured to one another by mating the male profile of one adjacent standing seam panel in the female profile of another adjacent standing seam panel with the respective detent structure of the female profile releasably locking with the second channel of the male profile and with the first end wall of the male profile positioned in a closely adjacent relation alongside the inner side web of female profile thereby retaining the male and female profiles of the adjacent standing seam panels in a mated state thereby to form a standing seam.

2. A standing seam panel according to claim 1 wherein said female profile, said male profile and said central panel section are constructed of a unitary piece of material.

3. A standing seam panel according to claim 2 wherein said piece of material is metal having longitudinal folds which form said male and female profiles.

4. A standing seam panel according to claim 1 wherein said central panel section is planar and wherein said inner web is oriented in a first plane which is perpendicular to said central panel section.

5. A standing seam panel according to claim 4 wherein said outer web is parallel to said inner web.

6. A standing seam panel according to claim 1 wherein said male profile includes a second end wall interconnected to said inset wall opposite said intermediate wall by a top wall that forms the upper portion of said male profile, said second end wall downwardly depending from said top wall in spaced-apart relation to said inset wall oppositely said central panel section to terminate in a second end wall distal edge.

7. A standing seam panel according to claim 6 wherein said second end wall extends downwardly alongside said first end wall to a location proximate the second lateral edge of said central panel.

8. A standing seam panel according to claim 6 wherein said second end wall and said inset wall are parallel to one another.

9. A standing seam panel according to claim 6 wherein said second end wall and said inset wall converge toward one another in a direction toward said top wall.

10. A standing seam panel according to claim 6 wherein said first and second end walls are oriented in a common second plane.

11. A standing seam panel according to claim 10 wherein said common second plane is perpendicular to said central panel.

12. A standing seam panel according to claim 11 wherein said inner side web is parallel to said common second plane.

13. A standing seam panel according to claim 1 wherein said inwardly facing ridge is V-shaped so that said first channel has a necked downwardly facing opening.

14. A standing seam panel adapted to mount on a surface as a protective covering, comprising:

(a) a central panel section having a longitudinal length and a width between opposite first and second lateral edges thereof;

(b) a female profile defining a first standing seam extending along the first lateral edge of said central panel and including an upstanding inner side web connected to said central panel section adjacent the first lateral edge thereof and an outer side web connected to said inner side web by a top web and downwardly depending therefrom to extend in spaced relation with respect to said inner side web oppositely said central panel section to form an inverted first channel having a downwardly opening mouth, said outer side web terminating in an inwardly facing ridge defining a detent structure of the mouth of the first channel; and (c) a male profile defining a second standing seam extending along side the second lateral edge of said central panel section and including an upstanding first end wall connected to said central panel section adjacent the second lateral edge thereof, an intermediate wall connected to said first end wall inwardly in opposed relation to said central panel section so that said intermediate wall, said first end wall and a portion of said central panel adjacent to the second lateral edge form a second channel having an opening facing toward said female profile, an inset wall connected to said intermediate wall opposite said first end wall and extending upwardly from said intermediate wall and a second end wall interconnected to said inset wall opposite said intermediate wall by a top wall that forms the upper portion of said male profile, said second end wall downwardly depending from said top said wall in a spaced-apart relation to said inset wall to terminate in a second end wall distal edge which is adjacent to said first end wall whereby said first and second end walls are oriented in a common plane and positioned in a substantially co-planar relationship, said male profile sized to matably engage said female profile with said second channel sized and positioned to receive said detent structure of said female profile whereby adjacent ones of said standing seam panels may be secured to one another by mating the male profile of one adjacent standing seam panel in the female profile of another adjacent standing seam panel with the respective detent structure of the female profile releasably locking with the second channel of the male profile and wherein said first and second end walls of the male profile are positioned in a closely spaced parallel relation with said inner side web of female profile thereby retaining the male and female profiles of the adjacent standing seam panels in a mated state thereby to form a standing seam.

* * * * *